United States Patent [19]

Loucaides

[11] 4,382,209

[45] May 3, 1983

[54] THERMAL SWITCH AND DUAL FILAMENT LONG LIFE LAMP

[75] Inventor: Nicholas Loucaides, Lyndhurst, Ohio

[73] Assignee: General Electric Company, Schenectady, N.Y.

[21] Appl. No.: 194,369

[22] Filed: Oct. 6, 1980

[51] Int. Cl.[3] ..... H05B 39/10

[52] U.S. Cl. ..... 315/65; 315/73; 315/74; 315/93; 315/362; 337/159; 337/229; 337/251

[58] Field of Search ..... 315/65, 73–75, 315/93, 119, 362; 313/236, 316; 337/221, 239, 142, 159, 229, 230, 251, 290

[56] References Cited

U.S. PATENT DOCUMENTS

| | | | |
|---|---|---|---|
| 1,468,264 | 9/1923 | Gordon | 315/65 |
| 1,838,372 | 12/1931 | DeCastro | 315/65 |
| 2,049,338 | 7/1936 | Trope | 315/65 |
| 2,114,511 | 4/1938 | Tremblay | 315/73 |
| 3,629,766 | 12/1971 | Gould | 337/239 |

*Primary Examiner*—Eugene R. La Roche

*Attorney, Agent, or Firm*—Norman C. Fulmer; Philip L. Schlamp; Fred Jacob

[57] ABSTRACT

A three-terminal thermal switch having a common connector arm biased against a terminal of fusible material. When the terminal is softened or melted by current, the connector arm is released and moves into contact against a second terminal. Positioned in the base of a long-life dual-filament incandescent light bulb, the switch causes one filament to be energized until it burns out, and then connects the other filament to be energized.

10 Claims, 3 Drawing Figures

THERMAL SWITCH AND DUAL FILAMENT LONG LIFE LAMP

BACKGROUND OF THE INVENTION

The invention is in the field of long-life incandescent light bulbs, and three-terminal thermal switches for switching from one condition to another in response to current overload.

One type of long-life light bulb has a filament designed to operate at relatively cool temperature, and therefore has longer life than a filament designed for overall economy. However, such a light bulb has lower light output and/or consumes more power than a conventional filament designed for overall efficiency of light output, power consumption, and life. Another type of long-life light bulb has two filaments and a switch which connects one filament to operate until it burns out and then connects the other filament to operate. One example of such a light bulb is disclosed in U.S. Pat. No. 1,468,264, in which an electromagnet and spring arm connect a second filament to the power source when the first filament burns out. U.S. Pat. No. 1,838,372, discloses a switch having a heater winding around a thermostat arm for switching in a second filament when the first filament burns out. In the field of thermal switches, U.S. Pat. No. 3,629,766 discloses an overload protection switch having a fusible link which melts when there is a current overload and causes the switch to open the circuit.

SUMMARY OF THE INVENTION

Objects of the invention are to provide an improved three-terminal thermal switch of reduced cost, and to incorporate the switch in a dual-filament long-life light bulb.

The invention comprises, briefly and in a preferred embodiment, a three-terminal thermal switch having a common connector arm biased against a terminal of fusible material. When this terminal is softened or melted by current, the connector arm is released and moves into contact against a second terminal. Positioned in the base of a long-life dual-filament incandescent light bulb, the switch causes one filament to be energized until it breaks or burns out, and then connects the other filament to be energized.

DESCRIPTION OF THE PREFERRED EMBODIMENT

Figure 1:
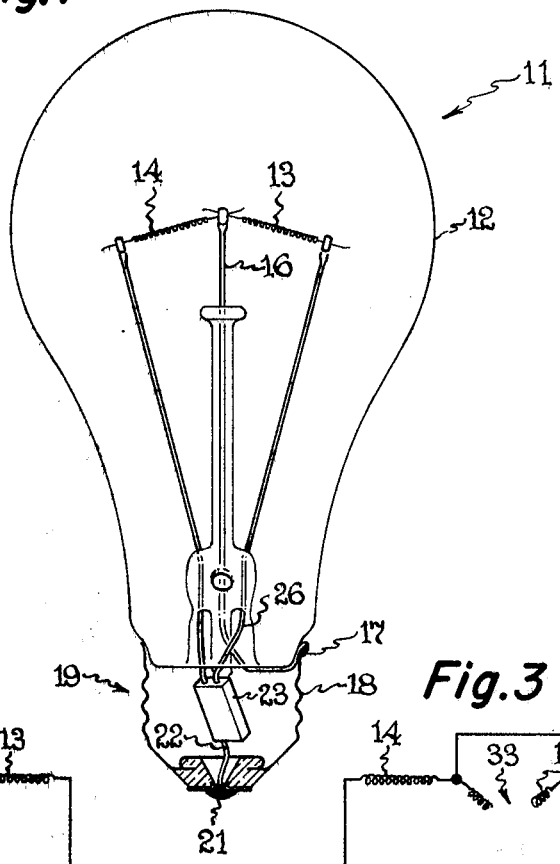
FIG. 1 shows a side interior view of a dual-filament light bulb incorporating the thermal switch of the invention in its screw base.

A light bulb 11 comprises a glass envelope 12 enclosing a first filament 13 and a second filament 14. An end of each filament is connected in common to a lead-in wire 16 which is connected at 17 to the shell 18 of a screw-in base 19. The button contact 21 of the base 19 is connected to a common terminal 22 of a thermal switch 23 positioned within the base 19. The switch 23 has a first output terminal 26 connected to the remaining end of the first filament 13, and a second output terminal 27 connected to the remaining end of the second filament 14.

Figure 2:
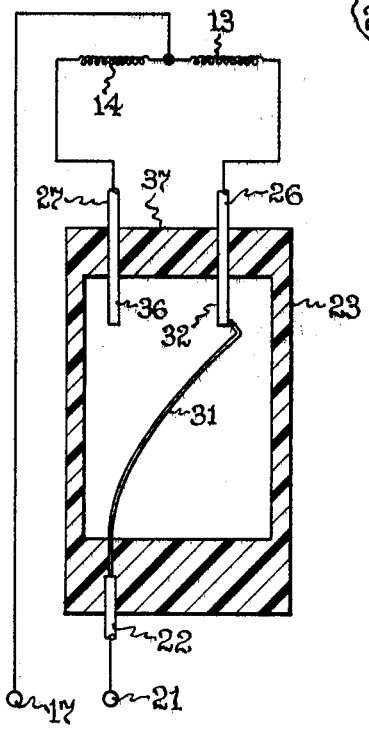
FIG. 2 shows the thermal switch in its condition for energizing a first filament of the light bulb.
Figure 3:
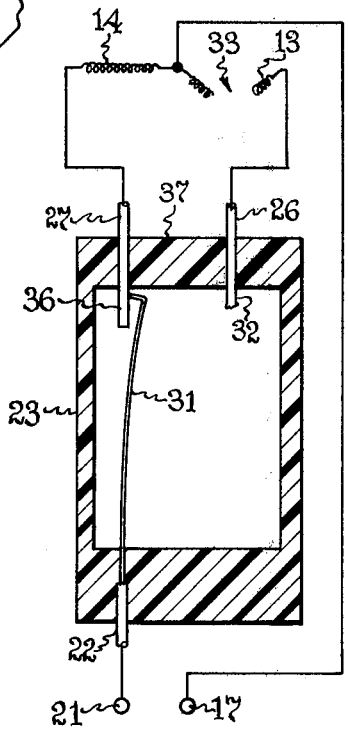
FIG. 3 shows the thermal switch in its condition for energizing a second filament of the light bulb after the first filament has burned out.

The switch 23 includes a common connector arm 31 connected to the common terminal 22 and resiliently biased, or biased by a spring or other means, against the outside surface of a thermally fusable member 32 in the switch which is connected to the first output terminal 26. As shown in FIG. 2, the arm 31 of the switch initially connects the button contact 21 to the far end of the first filament 13, whereby this first filament is energized and produces light whenever the light bulb is turned on. Eventually when this first filament 13 breaks while lighted or burns out, a well-known condition occurs wherein an electrical arc establishes momentarily between the severed or burned-out ends 33 of the filament 13 (FIG. 3), and this arc burns the severed ends of the filament and draws considerable over-current through the filament until the arc extinguishes when the arc-gap length becomes too great to sustain the arc. During this over-current condition the fusible material 32 melts or deforms, as shown in FIG. 3, so that the biased connector arm 31 is released from the fusible member 32 and it moves into contact with the switch terminal 27 and connects the circuit to the second filament 14 thereby energizing it for a "second life" of the light bulb. The second output terminal 27 may comprise a current-fusible member 36 where it is contacted by the arm 31, so that it melts or deforms when the second filament 14 burns out, whereby the common connector arm will move past it and break the connection to the second terminal 27 and open the connection to the second filament 14.

The fusible elements 32 and 36 may be nickel or other material which suitably deforms or melts in response to the over-current of the arc which occurs when a filament burns out or breaks, the material and its diameter and length being chosen to achieve the desired characteristics. The fuse elements 32 and 36, of nickel or other suitable material, may be welded to lead-in wires 26 and 27 of copper or other suitable material, at suitable locations such as where they pass through the wall 37 of the housing of the switch 23.

As explained above, the fusible element 32 functions to connect the second filament 14 when the first filament 13 breaks while lighted, or burns out, thus doubling the life of the bulb. Each of the filaments may be designed for an optimum combination of brightness, life, and electrical efficiency. Also, each of the fusible elements 32 and 36 performs a second function of quickly opening the circuit to the respective filament when it develops the arcing and resultant momentary current consumption. This momentary current may be as high as 40 or 50 amperes in a typical 120 volt light bulb, and can cause undesired effects in external circuitry, appliances connected to the circuit, and radio interference. The fusible elements 32, 36 quickly open the circuit of an arcing filament, and the arc extinguishes. It has been common practice to interpose a fusible link in a lead-in wire of light bulbs, for the same purpose.

While preferred embodiments and modifications of the invention have been shown and described, various other embodiments and modifications thereof will become apparent to persons skilled in the art and will fall within the scope of the invention as defined in the following claims.

What I claim as new and desire to secure by U.S. Letters Patent is:

1. A three-terminal switch having a common member biased against a side of a first terminal of fusible material, and a second terminal spaced from said first terminal, said first terminal being subject to melting or deforming upon overcurrent, whereby said common member is urged to move into contact with said second terminal.

2. A switch as claimed in claim 1, in which said second terminal comprises fusible material subject to melting or deforming upon overcurrent thereby causing said common member to move out of contact with said second terminal.

3. A switch as claimed in claim 1, in combination with a dual filament light bulb having first and second filaments, means connecting a first power connection to said common member, means connecting a second power connection to an end of each of said filaments, means connecting said first terminal to the remaining end of said first filament, and means connecting the second terminal to the remaining end of said second filament.

4. A switch as claimed in claim 3, in which said second terminal comprises fusible material subject to melting or deforming upon overcurrent thereby causing said common member to move out of contact with said second terminal.

5. A switch as claimed in claim 3, in which said switch is positioned in the base of the light bulb.

6. A switch as claimed in claim 1, including a housing, said first and second terminals being elongated and extending in mutually parallel relationship into said housing from a first wall thereof, said common member extending into said housing from a second wall thereof opposite said first wall.

7. A switch as claimed in claim 6, in which said second terminal comprises fusible material subject to melting or deforming upon overcurrent thereby causing said common member to move out of contact with said second terminal.

8. A switch as claimed in claim 6, in combination with a dual filament light bulb having a first and second filaments means connecting a first power connection to said common member, means connecting a second power connection to an end of each of said filaments, means connecting said first output terminal to the remaining end of said first filament, and means connecting the second terminal to the remaining end of said second filament.

9. A switch as claimed in claim 8, in which said second terminal comprises fusible material subject to melting or deforming upon overcurrent thereby causing said common member to move out of contact with said second terminal.

10. A switch as claimed in claim 8, in which said switch is positioned in the base of the light bulb.

* * * * *